US010895267B2

(12) United States Patent
Petit et al.

(10) Patent No.: US 10,895,267 B2
(45) Date of Patent: Jan. 19, 2021

(54) FINGER PUMP

(71) Applicant: KSB SAS, Gennevilliers (FR)

(72) Inventors: Nicolas Petit, Hazebrouck (FR); Stéphanie Gonzalez, Loos (FR); Mateusz Kaminski, Loos (FR); Christoph Jager, Gerolsheim (DE)

(73) Assignee: KSB SAS, Gennevilliers (FR)

( * ) Notice: Subject to any disclaimer, the term of this patent is extended or adjusted under 35 U.S.C. 154(b) by 128 days.

(21) Appl. No.: 16/276,309

(22) Filed: Feb. 14, 2019

(65) Prior Publication Data

US 2019/0257320 A1 Aug. 22, 2019

(30) Foreign Application Priority Data

Feb. 22, 2018 (FR) ..... 18 70195

(51) Int. Cl.

| | |
|---|---|
| ***F04D 29/42*** | (2006.01) |
| ***F04D 1/04*** | (2006.01) |
| ***F04D 7/04*** | (2006.01) |
| ***F04D 29/44*** | (2006.01) |

(52) U.S. Cl.

CPC ..... *F04D 29/4293* (2013.01); *F04D 1/04* (2013.01); *F04D 7/045* (2013.01); *F04D 29/445* (2013.01); *F05D 2250/52* (2013.01)

(58) Field of Classification Search

CPC ..... F04D 7/00; F04D 7/02; F04D 7/04; F04D 7/045; F04D 29/00; F04D 29/007; F04D 29/2288; F04D 29/42; F04D 29/426; F04D 29/4293; F04D 29/44; F04D 29/445; F04D 29/70; F04D 29/708; F04D 1/04; F05D 2250/52

USPC ..... 415/121.1

See application file for complete search history.

(56) References Cited

U.S. PATENT DOCUMENTS

2003/0215331 A1* 11/2003 Andersson ..... F04D 7/045 415/206
2010/0119365 A1* 5/2010 Andersson ..... F04D 15/0033 415/203

FOREIGN PATENT DOCUMENTS

| | | | |
|---|---|---|---|
| EP | 1 357 294 | A2 | 10/2003 |
| EP | 3 246 574 | A1 | 11/2017 |
| WO | 2009/020420 | A1 | 2/2009 |

OTHER PUBLICATIONS

French Search Report (Application No. FR 1870195) (2 pages—dated Oct. 10, 2018).

* cited by examiner

*Primary Examiner* — Igor Kershteyn
*Assistant Examiner* — Elton K Wong
(74) *Attorney, Agent, or Firm* — Renner Kenner Greive Bobak Taylor & Weber

(57) ABSTRACT

In this pump, the angle between the imaginary tangent plane to the lip and passing through the axis and an imaginary straight line, perpendicular to the axis and passing through the point furthest from the axis of intersection of the upper surface of a finger with the lateral leading surface of this finger, is between 110 and 140°.

14 Claims, 5 Drawing Sheets

FINGER PUMP

French patent 1 511 657, describes a pump, comprising an impeller with at least one blade. The impeller is surrounded by a volute. A deflector, projecting towards the interior of pump, is fixed to the volute, in the direction of rotation of the impeller, upstream of a groove machined in the volute. The deflector has one surface opposite the blade being at a macerating distance from it.

Deflector pumps are known from documents US 2003/215,331 and US 2010/119,365 and from WO 2017/198509.

This macerating pump suffers from the problem that in particular the deflector and blades wear rapidly, since together they must have a cutting effect.

The invention overcomes this problem by using a pump that is only macerating occasionally, but such as wet wipes, outside the pump, without necessarily having to cut them beforehand.

The pump according to the invention comprises:

an impeller rotating around a vertical axis and having at least one blade, a fixed volute having a lip and surrounding the impeller, a finger fixed to the volute just downstream of the input of a transverse groove machined in the inner wall of the volute, projecting below the blade in the direction of the axis and having an upper surface, of which at least a part, in particular at least 50%, is at a distance from the blade of 0.05 to 0.5 mm, and a lateral leading surface.

The pump is characterised in that the angle between the imaginary plane tangent to the lip and passing through the axis and an imaginary straight line, perpendicular to the axis and passing through the point furthest from the axis, from the intersection of the upper surface with the lateral leading surface, is between 110 and 140°.

To simplify the description of the invention, consider that the pump axis is vertical, but the pump can be positioned so that its axis is inclined or horizontal.

In the present application the words downstream and upstream mean only with respect to a section of the path on the volute having the shortest distance between the groove and the lip when turning in the direction of rotation of the impeller and no further when considering the widest arc between the lip and the groove. The finger just downstream of the inlet of the groove also means that before eventually entering the shortest section of the path, we first find the groove, then the finger, the latter being in particular immediately at the downstream edge of the input of the groove.

The lip of the volute is the internal edge of the discharge pipe, which is the furthest downstream in the direction in which the liquid is transported. The suction bottom, where present, is considered to form part of the volute. The finger may be fixed there. The volute is, for preference, in a spiral. The radial distance between its external wall and its internal wall increases from upstream to downstream of the lip finger. The groove is curved from upstream to downstream from the input to the output of the groove across the inner wall of the volute. It extends over an angle of about 80° to 100° and rises at an angle of 15 to 30° from the input to the output.

Thanks to the invention, the wipe therefore leaves the space between the impeller and the volute at a point as close as possible to the flow pipe thus being transported from it as soon as possible to the exterior of the pump, and even better when the volute is a spiral, which means that the distance between the impeller and the volute increases in the direction of rotation of the impeller from the lip of the volute to the flow pipe. The wipe then follows the shortest possible path between the inlet and the groove and therefore has less opportunity to roll up and cause a blockage by piling up with other wipes.

The invention relates also to a pump with characteristics that can be combined with those described above, but which can also be independent. This pump comprises:

an impeller rotating around a vertical axis and having at least one blade, a fixed volute surrounding the impeller, a finger fixed to the volute and projecting below the blade in the direction of the axis and having an upper surface, of which at least a part is at a distance from the blade of 0.1 to 1 mm, and a lateral leading surface, downstream of a lateral trailing surface, the pump is characterised in that the angle between the tangent to the downstream edge of the input of the groove and the edge between the upper surface and the lateral leading surface is between 180 and 150°. The longitudinal direction of the groove is therefore, a far as possible, within the extension of the upper surface, which prevents a wipe jamming before entering the groove.

When the blade or blades are inclined with respect to the axis, the upper surface has its convex side facing towards the blade. When the blade is in a plane perpendicular to the axis, the upper surface is flat.

The invention also concerns a pump whose characteristics can be combined with the characteristics described above, but may also be independent of them. In this pump, the upper surface of the finger is convex and its convex side faces the blade and the tangent to the upper surface, at the point furthest downstream, and forms, depending on the position in rotation of the blade, an angle of 50 to 140° with the tangent to the blade at the point aligned vertically with the said point furthest downstream. In addition, this angle increases with the rotation of the impeller shown by the arrow F when viewing the impeller from the suction side.

Thanks to that, a wipe is diverted better by the finger in the groove and is discharged from the pump without the pump performing a cutting action. However, if a blockage occurs, the special shape of the finger (like a shear) permits clean cutting of the fabric thereby avoiding as far as possible the creation of lint.

For improved cutting of a wipe in the event of a blockage, it is better if the angle between the imaginary tangent plane to the lateral leading surface passing through the line of intersection of the lateral leading surface and the upper surface and the imaginary tangent plane of the upper surface passing through the line of intersection of the lateral leading surface of the upper surface is between 60 and 90°.

A pump according to the invention is so efficient that it is sufficient to have only a single groove and a single finger. The hydraulic characteristics of the pump are therefore less impaired.

The finger is in particular in the form of a pyramid with three curved lateral faces.

In the attached drawings, given only as examples:

Figure 1:
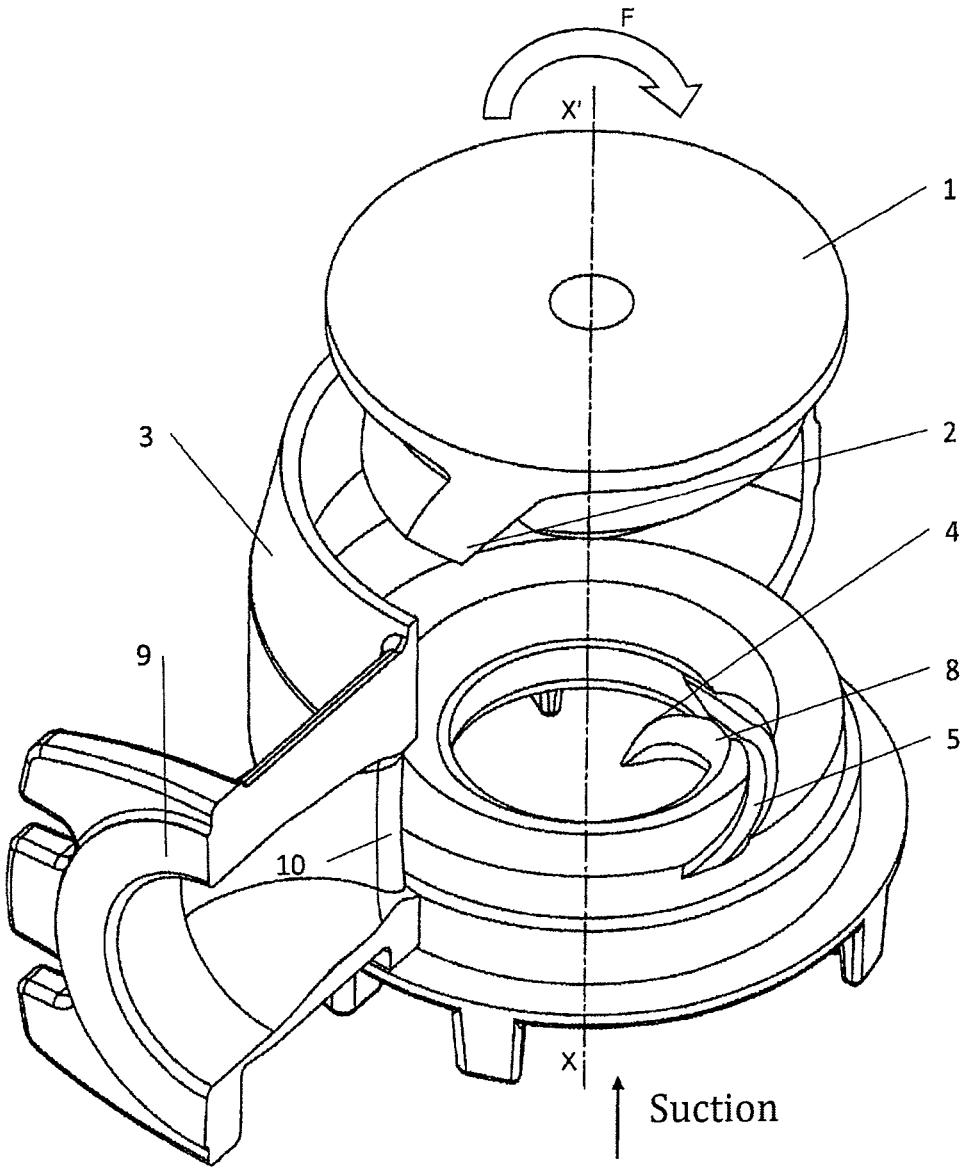
FIG. 1 is a partial exploded perspective view with the pump according to the invention pulled out.
Figure 2:
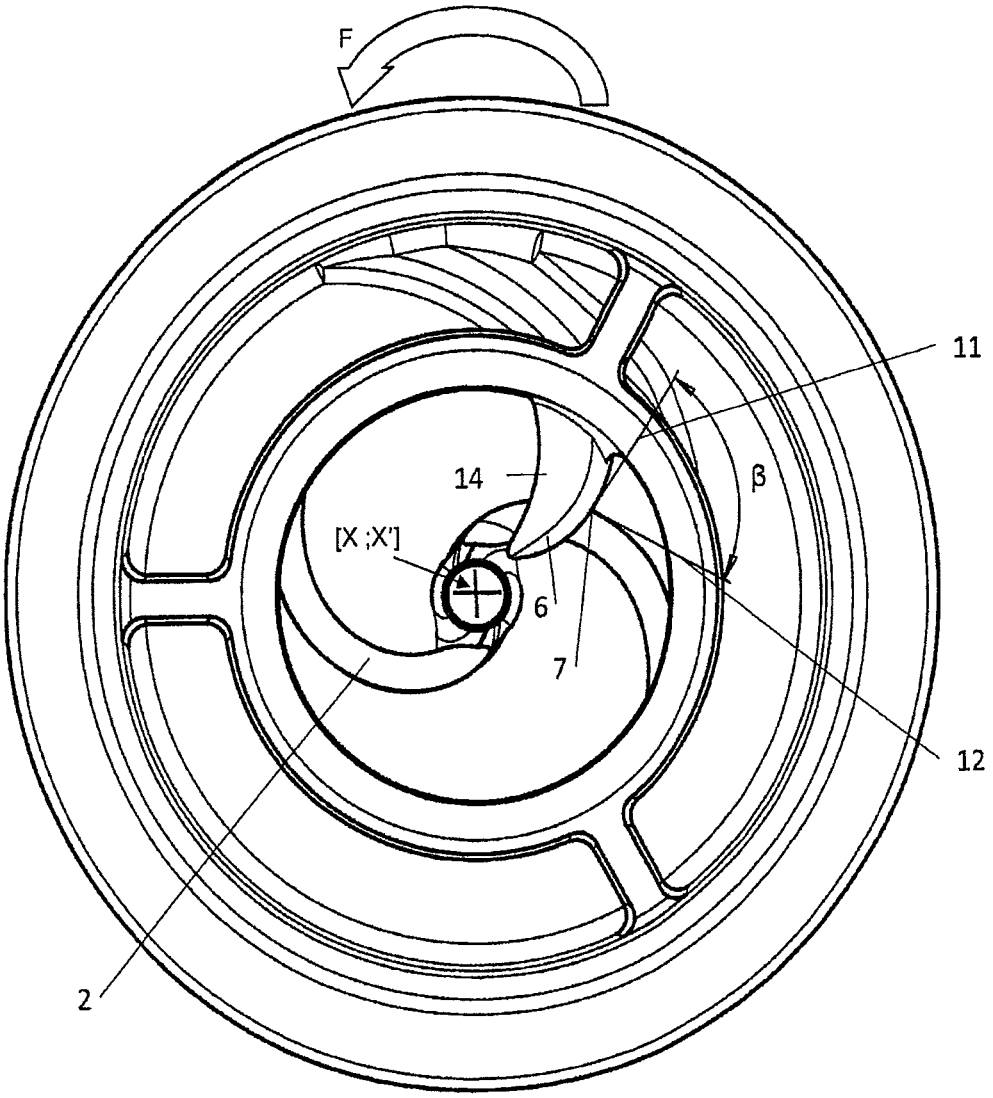
FIG. 2 is a view from the suction side of the pump from the bottom to the top with respect to FIG. 1.

The pump shown in FIG. 1 comprises an impeller 1 on a vertical axis X, X' having two blades 2. The impeller rotates in the direction of the arrow F driven by the output axis of a motor (not shown). The blades 2 are inclined to the axis X, X'. The impeller 1 is surrounded by a volute 3. The liquid to be transported enters the volute 3 through a suction inlet at the bottom of the pump. A finger 4 is fixed to the volute 3. A groove 5 is machined in the volute 3 and runs from the space between the impeller 1 and the volute 3 to the interior of the volute 3. A discharge tube leaves the volute 3 from a lip 10.

The finger 4 has a convex upper surface 8, the major part of which is 0.3 mm from the blades 2 when the latter pass in front of the finger 4. The tangent 11 to the upper surface 8 at its point furthest downstream forms with it, depending on the position in rotation of the blades 2, an angle β of 90° with the tangent 12 to the blade 2 at a point vertically aligned with the said point 7.

Figure 3:
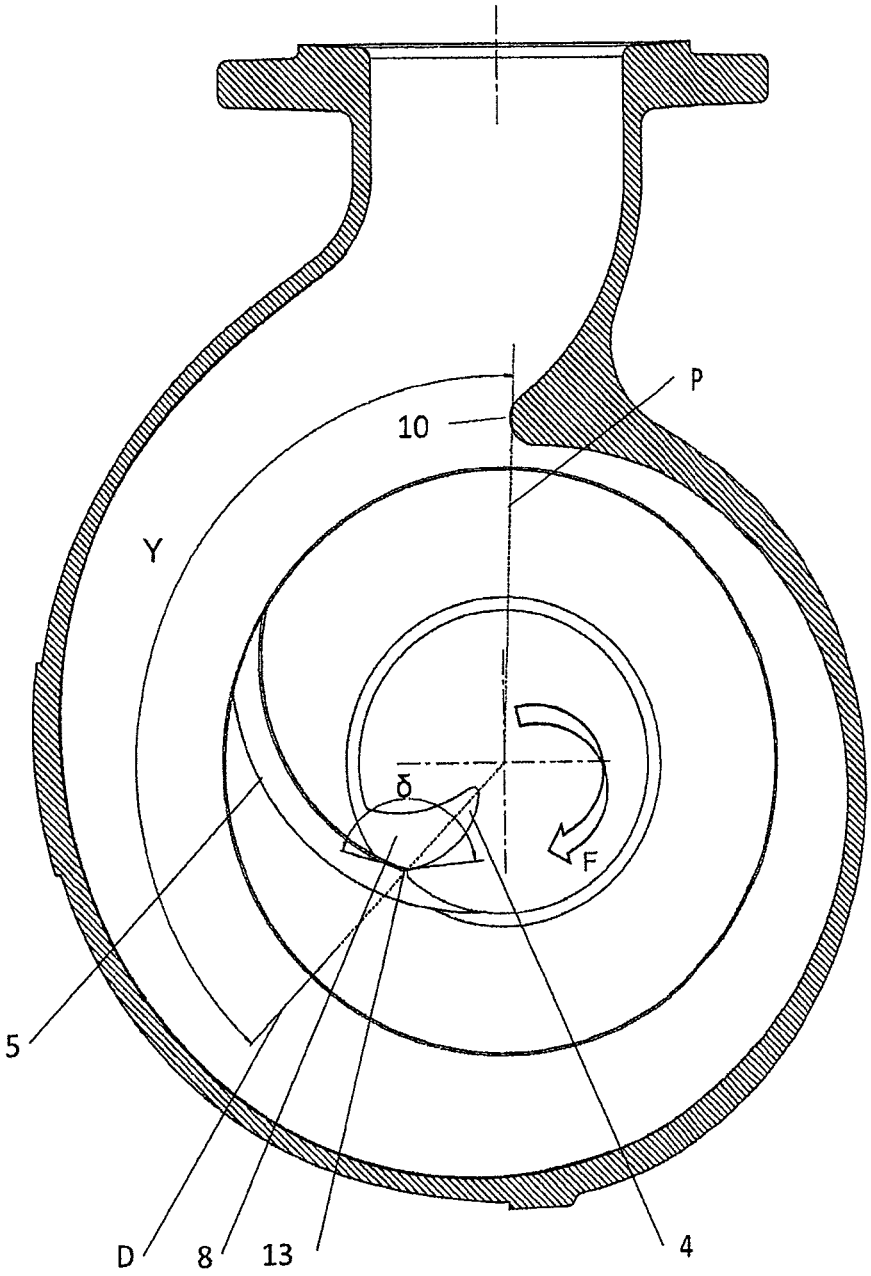
FIG. 3 is a cross-sectional view of the pump seen from above.

As shown in FIG. 3, the angle Y between the imaginary plane P tangent to the lip 10 passing through the axis X, X' and an imaginary straight line D passing through the intersection of the upper surface 8 with the lateral leading surface 6 of the finger 4 and perpendicular to the axis X, X' and at the furthest point from the axis X, X' (point 13) is 130°. The finger 4 is therefore at eight o'clock if the lip 10 is considered to be at midday.

The angle δ between the tangent to the downstream edge of the input of the groove 5 and the edge between the upper surface 8 and the lateral leading surface 6 is 170°.

Figure 4:
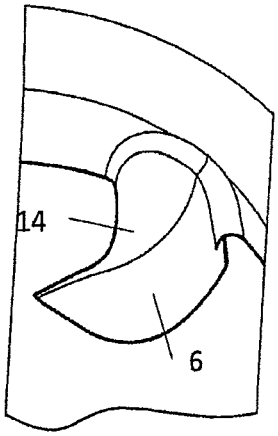
FIG. 4 is a perspective view from below of the finger.
Figure 5:
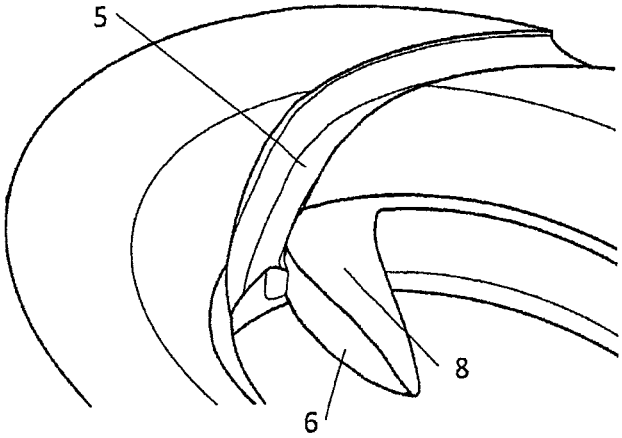
FIG. 5 is a perspective view from above of the finger.
Figure 6:
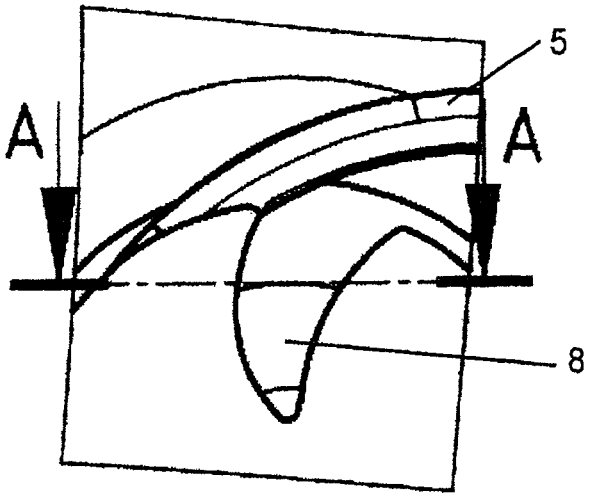
FIG. 6 is a view from above of the finger.

The finger 4 shown in FIG. 4 is in the form of a pyramid in which its upper surface 8, its lateral leading surface 6, and a lateral trailing surface 14, are all curved.

Figure 7:
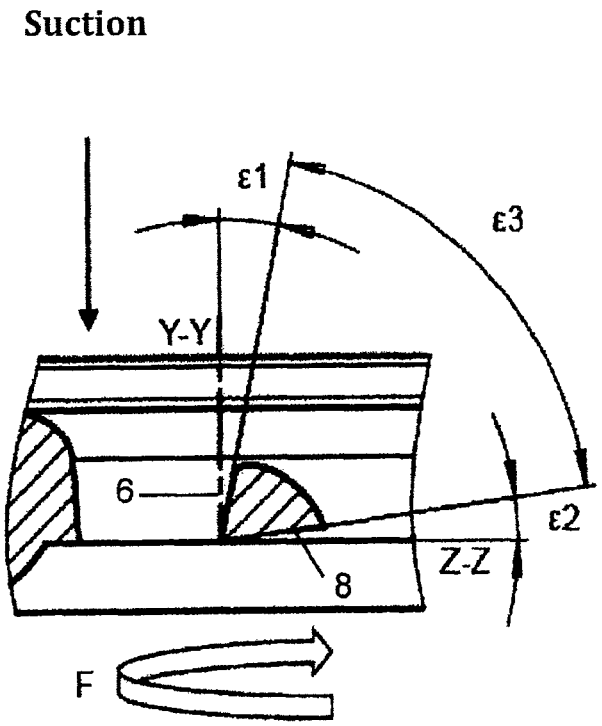
FIG. 7 is a cross-sectional view on line A-A in FIG. 6.

FIG. 7 shows that the angle ξ1 between the lateral leading surface 6 of the finger 4 and a vertical axis Y-Y is between 0 and 15°. It also shows that the angle ξ2 between the upper surfae 8 of the finger and a horizontal axis Z-Z, is between 0 and 15°. Summing the two angles and subtracting from 90° gives the angle ξ3, which is an acute angle of between 90 and 60°.

The invention claimed is:

1. A pump comprising:

an impeller rotating around a vertical axis and having at least one blade, a fixed volute having a lip and surrounding the impeller, a finger fixed to the fixed volute just downstream of an input of a crossing groove machined in an inner wall of the fixed volute, projecting below the blade in the direction of the axis and having an upper surface, of which at least a part is at a distance from the blade of 0.05 to 1 mm, and a lateral leading surface, an angle between an imaginary plane tangent to the lip and passing through the axis and an imaginary straight line, perpendicular to the axis and passing through a point furthest from the axis of an intersection of the upper surface of the finger with the lateral leading surface, is between 110° and 140°.

2. The pump according to claim 1, characterised in that the fixed volute is a spiral.

3. The pump according to claim 1, characterised in that an angle between the tangent to a downstream edge of the input of the crossing groove and an edge between the upper surface and the lateral leading surface is between 180° and 150°.

4. The pump according to claim 1, characterised in that: the upper surface is convex with its convex side facing the blade, a tangent to the upper surface, at its furthest point downstream, forms, depending on a position in rotation of the blade, an angle of 50° to 140° with a tangent to the blade at the point vertically aligned with the said furthest point downstream.

5. The pump according to claim 1, characterised in that there is only a single groove and a single finger.

6. The pump according to claim 1, characterised in that a part of the finger that is at a distance of 0.1 to 1 mm from the blade, represents at least 50% of a surface area of the upper surface.

7. The pump according to claim 1, characterised in that the finger has the form of a pyramid with three lateral curved faces.

8. The pump according to claim 1, characterised in that an angle between an imaginary tangent plane to said lateral leading surface passing through a line of intersection of said lateral leading surface and said upper surface and an imaginary tangent plane of the upper surface passing the line of intersection of the lateral leading surface and said upper surface is between 60° and 90°.

9. A pump comprising:

an impeller rotating around a vertical axis and having at least one blade, a fixed volute surrounding the impeller, a finger fixed to the fixed volute just downstream of an input of a crossing groove machined in an inner wall of the fixed volute, projecting below the blade in a direction of the axis and having an upper surface, at least part of which is at a distance from the blade of 0.05 to 1 mm, and a lateral leading surface, characterised in that an angle between the tangent to the downstream edge of the input of the crossing groove machined in the inner wall of the fixed volute and an edge between the upper surface and the lateral leading surface is between 18° and 150°.

10. The pump of claim 9 characterised in that the upper surface of the finger is convex with its convex side facing the blade and a tangent to the upper surface forms, at its furthest downstream point, depending on a position in rotation of the blade, an angle of 50° to 140° with a tangent to the blade at the point vertically aligned over said furthest downstream point.

11. The pump according to claim 10, characterised in that a part of the finger that is at a distance of 0.1 to 1 mm from the blade, represents at least 50% of a surface area of the upper surface.

12. The pump of claim 9, wherein an angle between an imaginary tangent plane to said lateral leading surface passing through a line of intersection of said lateral leading surface and said upper surface and an imaginary tangent plane to said upper surface passing the line of intersection of said lateral leading surface and said upper surface is between 60° and 90°.

13. The pump according to claim 9, characterised in that the fixed volute is a spiral.

14. The pump according to claim 9, characterised in that there is only a single groove and a single finger.

* * * * *